United States Patent [19]

Rubruck

[11] 4,278,213

[45] Jul. 14, 1981

[54] CONTROL ARRANGEMENT FOR A ROLL CARRIER

[75] Inventor: Manfred Rubruck, Igelsdorf, Fed. Rep. of Germany

[73] Assignee: Siemens Aktiengesellschaft, Berlin & Munich, Fed. Rep. of Germany

[21] Appl. No.: 139,752

[22] Filed: Apr. 14, 1980

[30] Foreign Application Priority Data

May 13, 1979 [DE] Fed. Rep. of Germany ..... 2917868

[51] Int. Cl.[3] ..... B65H 23/08; B65H 25/22

[52] U.S. Cl. ..... 242/75.1; 242/67.5; 242/75.44

[58] Field of Search ..... 242/67.5, 75.4, 75.1, 242/75.44, 75.5, 75.51, 75.53; 318/6, 7

[56] References Cited

U.S. PATENT DOCUMENTS

| | | | |
|---|---|---|---|
| 2,233,015 | 2/1941 | Kassell | 242/75.44 |
| 3,257,086 | 6/1966 | Drenning | 242/75.4 |
| 3,630,462 | 12/1971 | Nordgren | 242/75.50 |
| 3,737,115 | 6/1973 | Baker | 242/75.1 |
| 3,979,080 | 9/1976 | Herbert | 242/67.5 |
| 4,199,118 | 4/1980 | Tetro | 242/75.51 |

FOREIGN PATENT DOCUMENTS

| | | | |
|---|---|---|---|
| 2651620 | 7/1977 | Fed. Rep. of Germany | 242/75.1 |

*Primary Examiner*—Edward J. McCarthy
*Attorney, Agent, or Firm*—Kenyon & Kenyon

[57] ABSTRACT

A control arrangement for a roll carrier in which the speed control is continuously optimized by a computer taking into account the moment of inertia of the roll. The computer responds to an initial value of the moment of inertia which is determined during acceleration of a new roll and from the instantaneous radius of the winding, providing a signal for regulating the gain of a speed controller connected to the drive for a roll on the carrier.

5 Claims, 8 Drawing Figures

CONTROL ARRANGEMENT FOR A ROLL CARRIER

BACKGROUND OF THE INVENTION

This invention relates to a control arrangement for a roll carrier for supplying a web as it is unrolled. More particularly, the invention relates to a roll carrier for providing a web with a predetermined tension having an associated electric drive and braking machine having a speed control and means for continuously determining optimized speed control parameter from the system parameters.

Operation of control arrangements for roll carriers with fixed speed control parameters is generally unsatisfactory because the time constant of the system changes within wide limits during an unwinding operation. The time constant changes because the moment of inertia of the winding rapidly decreases with decreasing diameter. In DE-OS No. 27 32 644, continuous determination of optimized control parameters as a function of the changing system parameters is provided for. There the instantaneous moment of inertia is determined by a computer from input quantities for the width of the web, the specific density of the material, and the instantaneous radius of the winding. There, also, the width of the web could be determined by a mechanical measuring device.

It is an object of the present invention to develop the control arrangement for a roll carrier of the type disclosed in DE-OS No. 27 32 644 in such a manner that inputs or measurements of the specific density of the web material and of the web width are no longer necessary.

SUMMARY OF THE INVENTION

According to the invention, this problem is solved by providing for computer determination of the optimized control gain and/or the optimized integral-action time of the speed control form an initial determination of the value of the moment of inertia made during start-up of the new roll, and from the instantaneous radius of the winding.

In the control arrangement of the invention, input or measuring devices for the specific density of the material and the width of the web are no longer necessary. The optimized control parameters are determined completely automatically from the changing system parameters. Besides reducing of the cost of construction, the invention also provides increased assurance against incorrect operation.

According to one preferred embodiment of the invention, a belt-driven roll carrier is provided with a circuit arrangement for determining the initial value of the moment of inertia of the winding from measured values for: the synchronous speed; the time until synchronous speed is reached; the driving torque of the drive motor; the initial value of the winding radius; and from predetermined values for the moment of inertia of the drive and for the radii of the drive rollers of the belt drive.

In a roller carrier having direct drive there is provided, according to another preferred embodiment of the invention, a circuit arrangement which determines the initial value of the moment of inertia of the winding from measured values for: the synchronous speed; the time until the synchronous speed is reached; the driving torque of the drive motor; and a predetermined value for the moment of inertia of the drive.

DETAILED DESCRIPTION OF THE INVENTION

Figure 1:
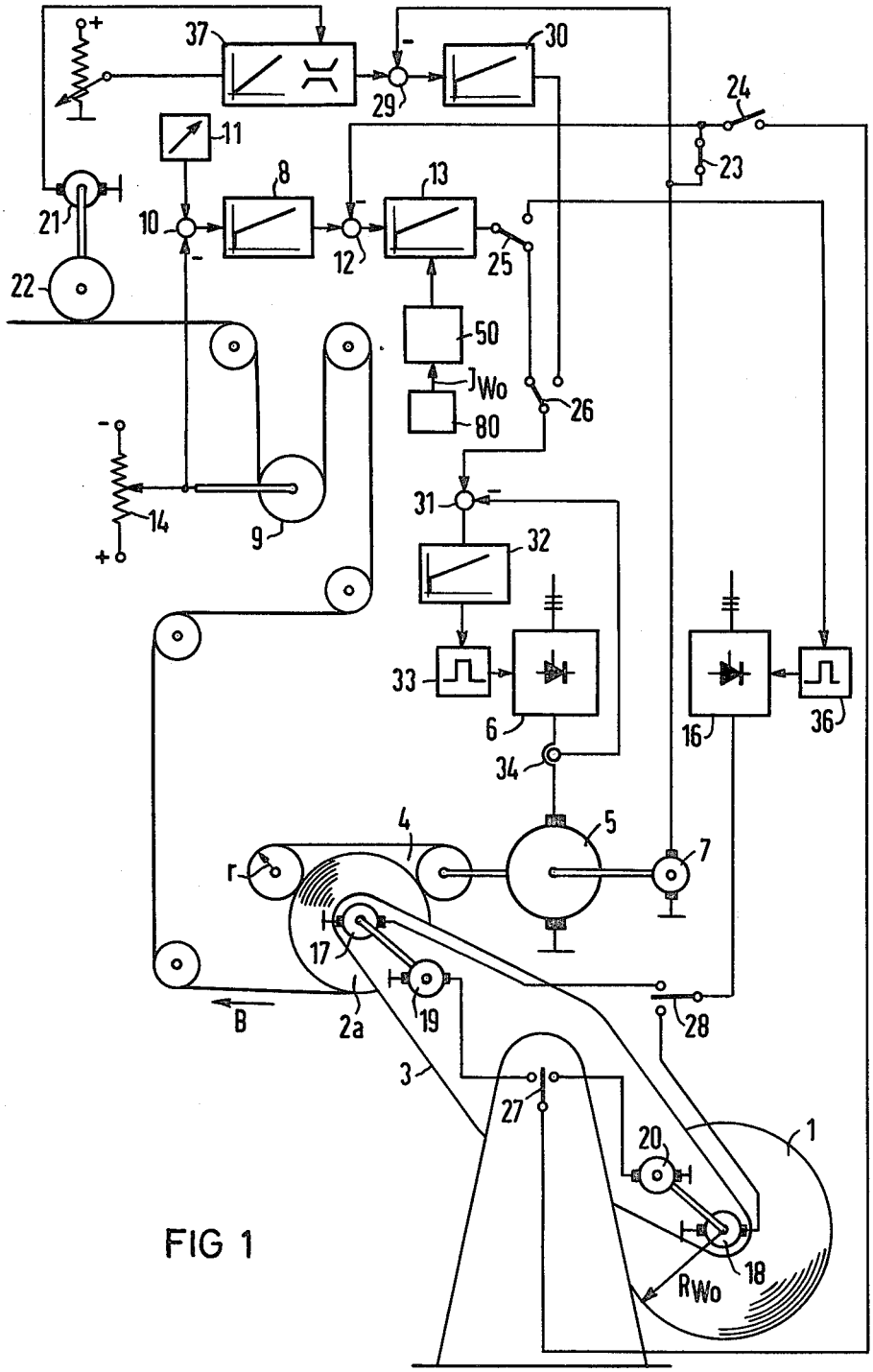
FIG. 1 is a schematic diagram of a roll carrier having a belt drive which is shown in the normal unwinding position.
Figure 2:
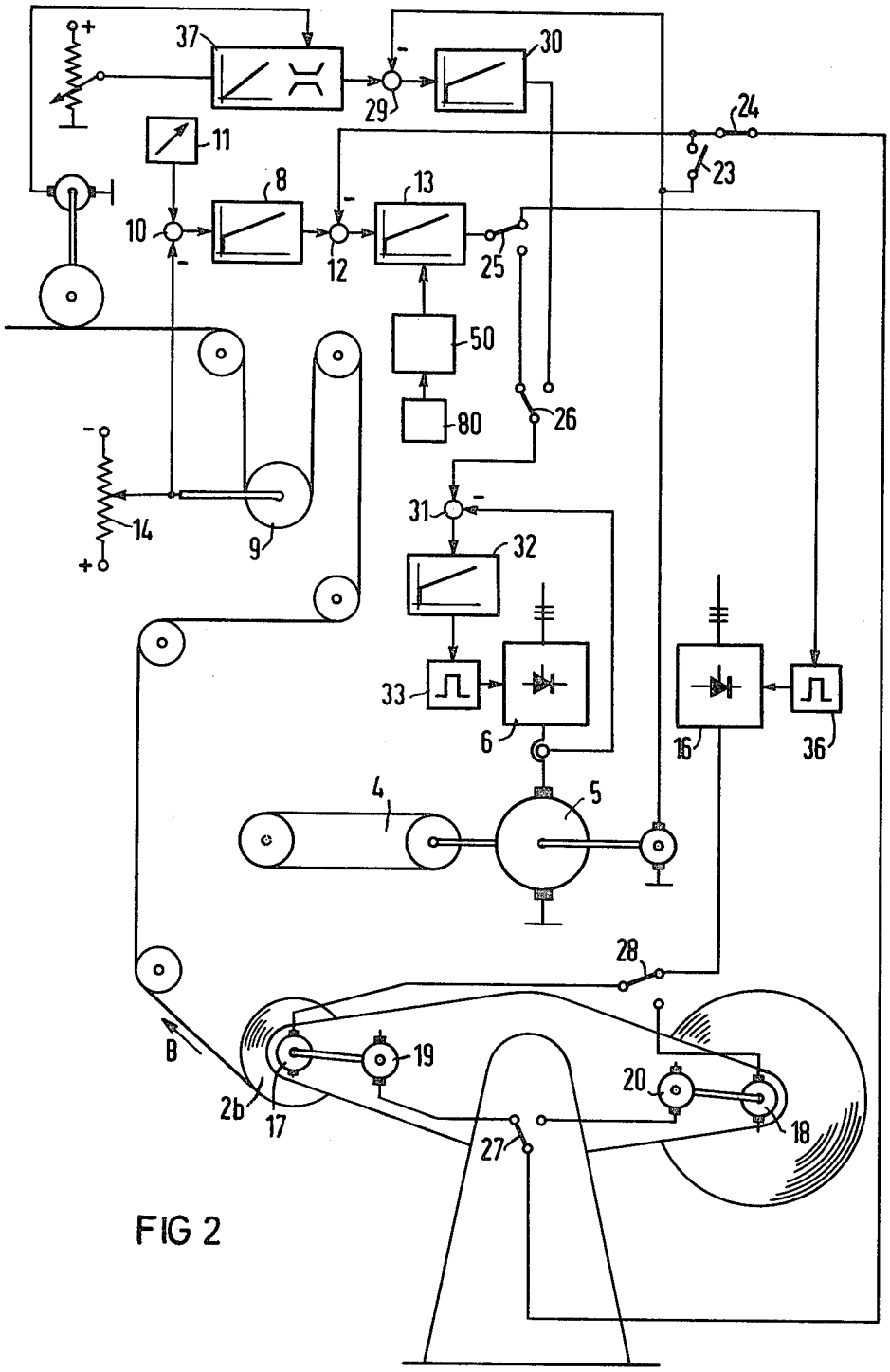
FIG. 2 shows the roll carrier of FIG. 1 in an intermediate position while swinging into the gluing position.
Figure 3:
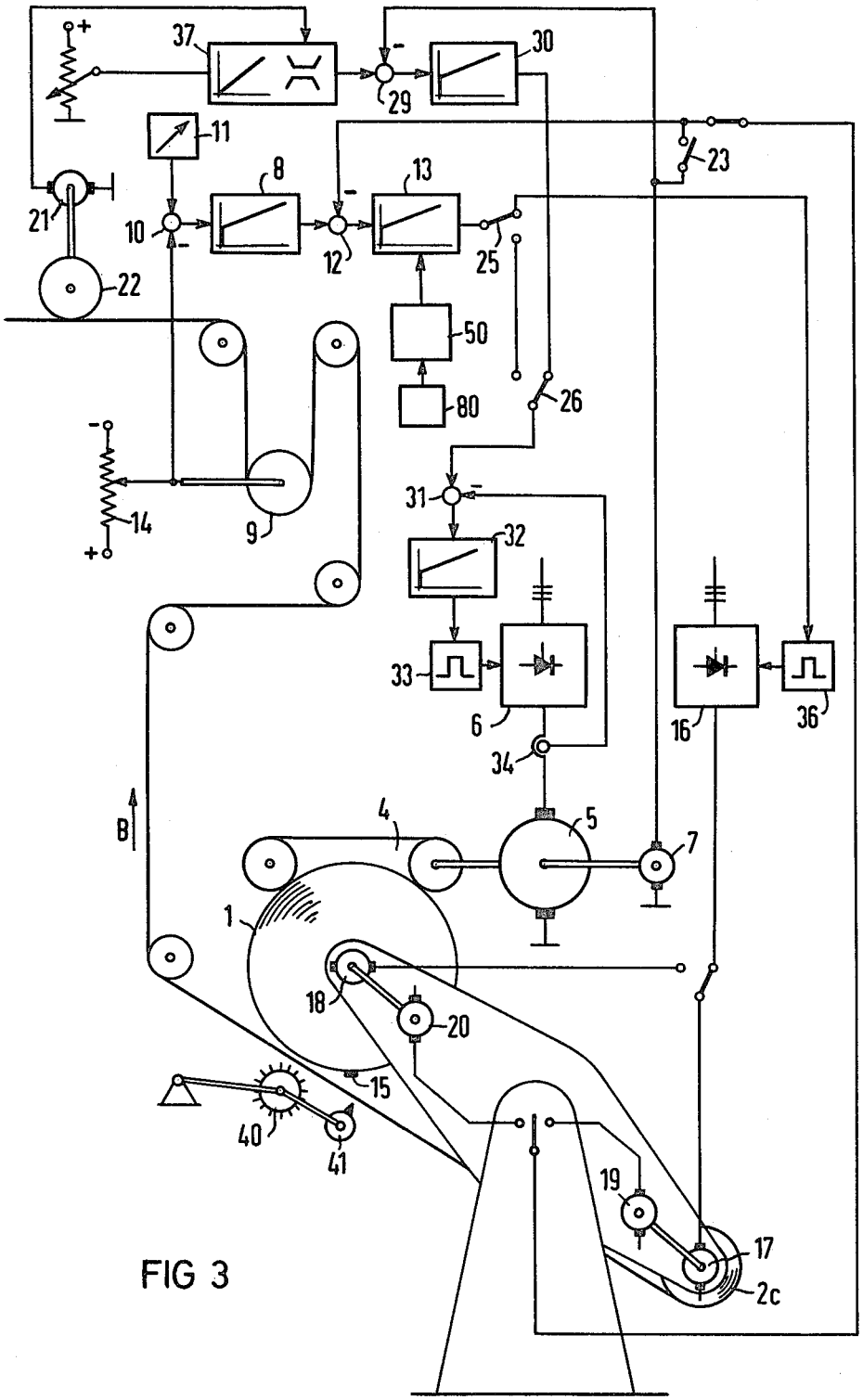
FIG. 3 shows the roll carrier of FIGS. 1 and 2 in the gluing position.

FIGS. 1 to 3 show a two-arm roll carrier 3 having a belt drive 4; the carrier can be swung from the its normal unwinding position (FIG. 1) by a tilting drive, not shown, through an intermediate position (FIG. 2), into the gluing position (FIG. 3). Such roll carriers are also sometimes constructed with three arms. The unwinding roll (winding 2) is rotatably supported. On one arm of roll carrier 3. The unwinding roll is always designated as roll 2 and the individual phases of the unwinding process are indicated by marking the roll 2*a*, 2*b* or 2*c*. A web B, which may be of paper, is pulled from winding 2 in the direction of the arrow and fed, via deflection rolls, not numbered, to a pulling group, also not detailed. At the other arm of the roll carrier 3, a new roll 1 is shown already in place.

In the unwinding position of roll carrier 3 illustrated in FIG. 1, unwinding roll 2*a* runs under a belt drive 4. Belt drive 4 is driven by an electric machine 5 which may be a motor and which is fed from a rectifier (converter) 6. Rectifier 6 is supplied with firing pulses by a control unit 33, the control voltage for which is formed by a current controller 32, the input to which is supplied a comparator 31. Electric motor 5 is coupled to a tachometer generator 7 which generates a tachometer voltage proportional to the actual speed value.

In this illustrative embodiment, the web B is being run with constant web tension into a following processing machine, such as a printing press. The web tension is controlled via belt drive 4. Belt drive 4, in turn, is controlled by a device which includes a position control 8, a speed control 13, and a subordinated current controller 32 as a function of the position of a compensating roller 9, being regulated in such a way that compensating roller 9 remains in the center of its positioning range. Compensating roller 9 can be gravity loaded, as shown, or can be pre-tensioned pneumatically for example. An actual value for the position of the compensating roller is taken off of a potentiometer 14, shown schematically , and is compared in a comparator 10 with a position reference value supplied by a setting device 11. A difference in position drives position control 8, the output voltage of which forms the speed reference value for speed control 13. For this purpose, the speed reference value is compared in second comparator 12 with the tachometer voltage of tachometer generator 7 as the actual speed value. This is connected, via switch 23, which is closed, to comparator 12. A difference control signal formed in comparator 12 drives speed control 13, and the output signal of control 13 is fed, via the contacts of double-throw switches 25 and 26, which are positioned as shown, to a comparator 31 as the current reference value. In comparator 31, the current reference value is compared with the actual motor drive current value as measured by a current measuring transformer 34 and a difference control signal is fed to the current control 32. The output voltage of current control 32 is the control voltage for control unit 33 of rectifier 6. Thus, the output voltage of speed control 13 determines the speed of motor 5 and, via belt drive 4, the speed of winding 2*a*.

The problem in a speed control of this type is the considerable change in the properties of the controlled system which occurs during the unwinding process. During unwinding, the diameter of the roll can decrease, for instance, from 1 m to 0.1 m. In addition, depending on the production program, webs having different widths in a range of about 1:4 can be used. Also the specific gravity of the web material used can vary. Accordingly, the mass of the roll can change over a very wide range. The mass of the winding constitutes a substantial share of the total moment of inertia of the controlled system. Due to the ranges of the parameters just mentioned, the moment of inertia of a roll can change over a range greater than 1:1000. In a conventional speed control, the control parameters of the speed controller are customarily set so that stability conditions are fulfilled over the entire control range. However, with such fixed control parameters, the speed control cannot operate optimally over the entire control range, because the system parameters vary over a wide range due to the large differences in the moment of inertia of the winding. Therefore, in the systems of the invention optimized control parameters for the speed controller 13 are continuously determined from the system parameters by a computing device 50 and the speed controller 13 is set accordingly.

The following quantities are used in the text which follows:

a: —Optimization factor for the control gain
A: —term according to Eq. (10) specific to the winding
d: —subscript for a direct drive
g: —subscript for a belt drive
$I_a$: —Armature current
J: —Moment of inertia referred to the drive ($J_o$=initial value)
$J_M$: —Moment of inertia of the drive
$J_W$: —Moment of inertia of the winding ($J_{Wo}$=initial value)
$k_a$: —constant factor according to Eq. (3)
$k_d$: —specific factor for a direct drive according to Eq. (16d)
$k_g$: —specific factor for a belt drive according to Eq. (11g)
$n_s$: —synchronous speed; $n_n$=nominal speed
$M_k$: —constant driving torque
r: —radius of the drive rollers of the belt drive
$R_W$: —radius of the winding ($R_{Wo}$=initial value)
$T_I$: —integral-action time of the control
$T_S$: —time constant of the system ($T_{So}$=initial value)
$T_{So}$: —initial value of $T_S$
$T_u$: —delay time of system
$t_s$: —time until $n_s$ is reached
$V_K$: —loop gain
$V_R$: —control gain
$V_S$: —system gain Numerous optimizing algorithms are known for the adjustment of control processes, such are described, for instance, in Winfried Oppelt, "Kleines Handbuch Technischer Regelvorgaenge" (Small handbook of technical control precesses), 3rd edition 1960, pages 418 to 433, especially page 427. For the best adjustment of a control loop, distinction must be made as to whether it is to be optimized for levelling out disturbances or for changing the control input, since a control process must be adjusted differently depending on whether it is to compensate a disturbance as quickly as possible or whether it is to follow an input signal as faithfully as possible. It must further be distinguished whether an aperiodic control process with the shortest duration is desired or whether a certain amount of overshoot is permitted, for instance, 20% overshoot with a minimum oscillation time. Finally, whether the control used is a P-control, a PI-control or a PID-control must also be taken into consideration.

The following explanations are given by way of example for a PI-control which is to level out a disturbance as fast as possible, with 20% overshoot permitted with the shortest oscillation time. The optimizing factors according to Chien, Hrones and Reswick are used (loc. cit., page 427).

For the optimized loop gain, the optimizing condition (1) generally applies:

$$V_K = a(I_S/T_u) \tag{1}$$

where the optimization factor a for the desired control behavior can be chosen as 0.7.

The delay time $T_u$ of the system is substantially the sum total of the armature time constant of the motor 5 and of the dead time of converter 6. These times are independent of the moment of inertia of the winding. In this consideration, the delay time $T_u$ can be considered, in approximation, as constant.

The loop gain $V_K$ of the control loop is the product of the controller gain $V_R$ and the system gain $V_S$. The system gain $V_S$ is the product of all individual gains, for instance, the gains of the measuring transmitters, the subordinated controls, the converter and the drive. The system gain is approximately independent of the moment of inertia of the winding and can therefore likewise be considered as constant. The loop gain $V_K$ is the product of the control gain $V_R$ and the system gain $V_S$ according to Eq. (2):

$$V_K = V_R \cdot V_S \tag{2}$$

If one substitutes in Eq. (2) the optimizing criterion (1) for the loop gain, one obtains Eq. (2.1) for the optimized controller gain $V_R$:

$$V_R = \frac{a}{T_u \cdot V_S} \cdot T_S \tag{2.1}$$

It is seen from Eq. (2.1) that the optimized control gain $V_R$ is directly proportional to the time constant $T_S$ of the control system, since the optimization factor a, the delay time $T_u$ of the system and the system gain $V_S$ are approximately constant. If one introduces a constant factor $k_a$ according to Eq.(3):

$$k_a = \frac{a}{T_u \cdot V_S} \quad (3)$$

(3)

then Eq. (2.1) assumes the form (2.2):

$$V_R = k_a \cdot T_S \quad (2.2)$$

The problem is now that the continuously changing time constant $T_S$ of the system is required for continuously determining the optimized control gain $V_R$. Since the change of time constant $T_S$ of the system is essentially determined by the change of the moment of inertia $J_W$ of the winding, a continuous determination of the moment of inertia $J_W$ or the winding is performed, according to the invention, from an intitial value $J_{Wo}$ and the associated winding radius $R_W$. What is required is, therefore, the function (4):

$$T_S = f(J_{Wo}, R_W) \quad (4)$$

For determining the parameters of the control system, which contains, essentially, electric motor 5 and roll 2*a* as a rigidly coupled load, the time which the drive requires to accelerate a new roll with a constant torque from standstill to a given speed can be used.

Assuming a largely linear acceleration of a new roll at a given constant driving torque $M_k$, preferably the rated (nominal) torque, from standstill to a given speed $n_s$, we have for the time ts required to reach the predeterminedd speed $n_s$ Eq. (5):

$$t_s = \frac{2\pi \cdot n_s}{M_K} \cdot J_o \quad (5)$$

Eq. (5) can be transformed for the initial value $J_o$ of the total moment of inertia referred to the drive into Eq. (5.1):

$$J_o = \frac{t_s \cdot M_K}{2\pi \cdot n_s} \quad (5.1)$$

For a winding driven by a belt drive (subscript g) we have $$J_o = J_M + \left(\frac{R_{Wo}}{r}\right)^2 \cdot J_{Wo} \quad (6g)$$

For the initial value $J_{Wo}$ of the moment of inertia of the winding, Eq. (6 g) can be transformed into Eq. (6.1 g);

$$J_{Wo} = (J_o - J_M) \cdot (r/R_{Wo})^2 \quad (6.1\ g)$$

If Eq. (5.1) is substituted into Eq. (6.1g), Eq. (6.2 g) is obtained:

$$J_{Wo} = (t_s \cdot M_K / 2\pi \cdot n_s - J_M) \cdot (r/R_{Wo})^2 \quad (6.2\ g)$$

The initial value $J_{Wo}$ of the moment of inertia of the winding can therefore be calculated if the values on the right-hand side of Eq. (6.2) are known. Before discussing the determination of the initial value of the moment of inertia of the winding in detail, the cycle of a roll change will first be explained with reference to FIGS. 2 and 3.

As soon as the diameter of the roll winding falls below a given value, belt drive 4 is lifted off the winding 2*b*, as shown in FIG. 2. The arm of roll carrier 3 is rotated. The control of the tension of web B as it unwinds is now accomplished by electrical braking devices such as the schematically shown induction brakes 17 and 18. Induction brakes 17 and 18 are coupled to the roller shafts and to tachometer generators 19 and 20. It is determined, through the position of the switch contacts of the double-throw switches 27 and 28, when induction brake 17 associated with winding 2*b* becomes operative together with tachometer generator 19, if the belt drive 4 ceases to contact winding 2*b*. In the normal unwinding position, induction brakes 17 and 18 are not operative. In the presentation of FIG. 1, the switch contacts of double-throw switches 27 and 28 are shown in middle positions so that neither of the two induction brakes 17,18 are operative and the tachometer voltages of the tachometer generators 19, 20 are not processed further. For better understanding, double-throw switches 27 and 28 are shown simplified in FIGS. 2 and 3 by omission of connections to the respective inoperative induction brake and tachometer generators.

FIG. 2 shows the roll carrier in an intermediate position during counterclockwise rotation from the unwinding position shown in FIG. 1 into the gluing position shown in FIG. 3. Belt drive 4 has been lifted off and the contacts of switches 27 and 28 were, at the same time, moved into the positions shown . The speed of roll 2*b* is no longer controlled by the belt drive but by induction brake 17. The actual position value of compensating roller 9 is taken off at potentiometer 14 and compared in comparator 10 with the position value set in on setting device 11. The output voltage of position control 8 forms the speed reference value which is compared in second comparator 12 with an actual speed value. This actual speed value is delivered, in this position of the roll carrier, via closed switch 24 from tachometer generator 19, which, in turn, is coupled to roll 2*b*. The output voltage of the speed control is fed via the switch contact of double-throw switch 25 as control voltage to control unit 36 of second converter 16. Converter 16 is the control element for induction brake 17 which acts on winding 2*b*.

FIG. 3 shows roll carrier 3 in the gluing position, in which the web end of new roll 1 is glued to the unwinding web B while running. (This operation is described in detail, for instance, in DE-OS 26 19 236). The winding has run down to the residual roll diameter. Induction brake 17 continues to be engaged. New roll 1 is under belt drive 4 and belt drive 4 is lowered onto it.

So that new roll 1 can be glued to the web B on the fly, the circumferential velocity of new roll 1 must, first of all, agree with the web velocity. To establish this agreement, a speed control 30 and a starting-up transmitter 37 preceding it are provided. Starting-up transmitter 37, which may be an integrator with a limiter connected thereto, brings the reference value for speed control 30 to the synchronous speed ns following a fixed ramp fundtion; there, the circumferential velocity of the new roll agrees with the web velocity. The slope of the ramp function is chosen so that machine 5 is operated in this acceleration phase with approximately constant armature current. For the formation of a tachometer voltage corresponding to the synchronous speed ns, a tachometer generator 21 is provided which is driven by the unwinding web B via a friction wheel 22. The tachometer voltage output of tachometer generator is therefore a measure of web velocity. The required synchronous speed ns is in a fixed ratio thereto since the circumferential velocity of the new roll corresponds to the velocity of the belt of belt drive 4, which, in turn, is known from the speed of drive motor 5 and the reduction ratio of the belt drive.

The output voltage of starting-up transmitter 37 is compared in comparator 29 with the tachometer voltage output of tachometer generator 7. The difference control output drives speed control 30. The output voltage of speed control 30 is transmitted via double-throw switch 26 as a reference value for subordinated current regulator 32. The new roll is thereby accelerated, under control of speed controller 30 and subordinated current regulator 32, to the synchronous speed $n_s$, where starting-up transmitter 37 provides for uniform acceleration with a largely constant armature current and thus also largely constant driving torque.

When the circumferential velocity of new roll 1 agrees with the velocity of unwinding web B, the gluing operation is performed by pressing web B, as it slows down, against an adhesive tab 15 on new roll 1 by means of a cylinder brush 40. The web unwinding from the old roll is cut behind the glue point by a fly cutter 41. Immediately after the fluing operation, the belt drive again takes over the speed control of the new roll. To this end, only deceleration of the new roll is initially necessary. The belt drive including drive motor 5 and rectifier 6 is therefore realized as a 4-quadrant drive, preferably using a converter in a circulating current-free antiparallel circuit. The transition of the control of the belt drive from acceleration of the new roll to the synchronous speed ns, where the circumferential velocity of new roll 1 agrees with the web velocity of unwinding roll B, to speed control for constant web tension is accomplished by providing for transfer of the switch contacts of the switching devices back into the position shown in FIG. 1. Residual roll 2c is then taken off the shaft of the roll carrier and a new roll is slipped on.

The acceleration of new roll 1 is used to determine the values required for solving Eq. (6.2). First, determination of the winding radius is described, making reference to FIG. 4.

Figure 4:
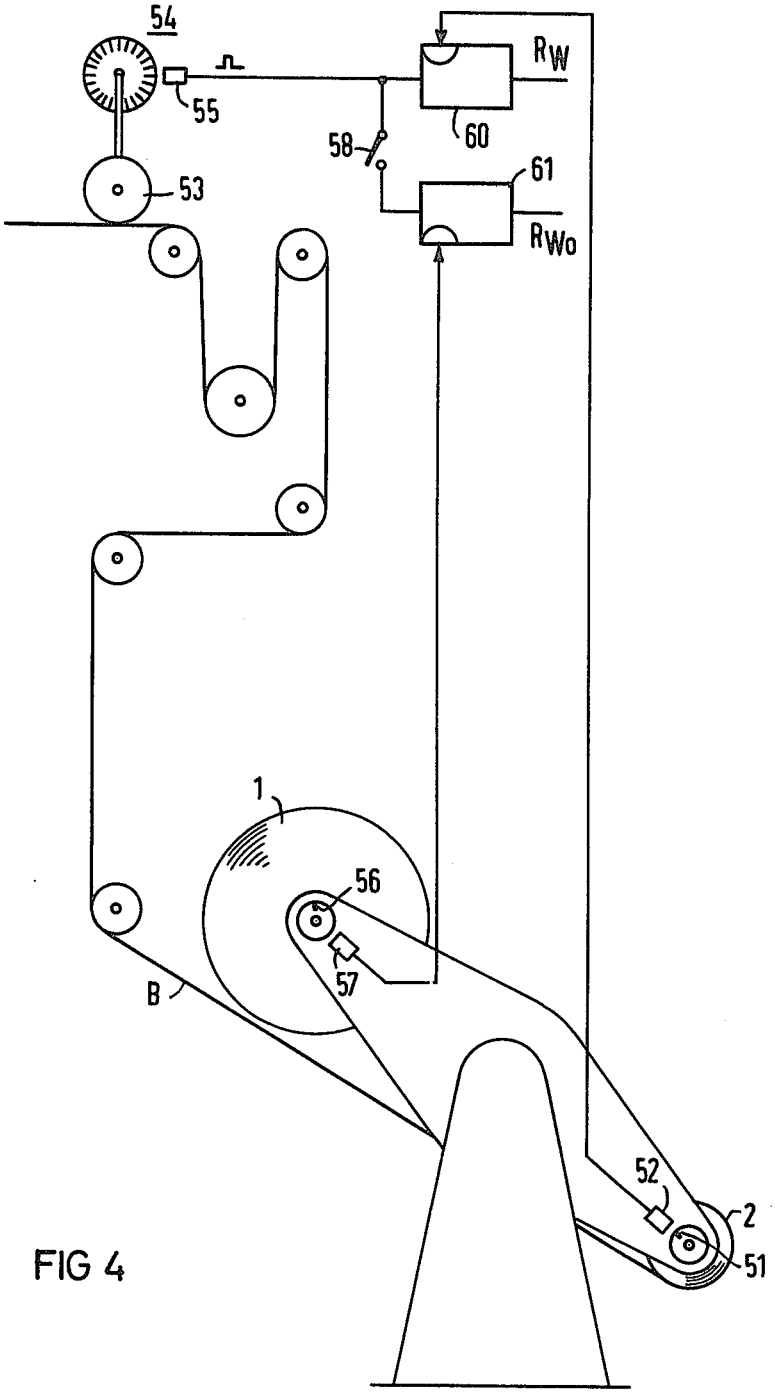
FIG. 4 is a schematic drawing of a measuring arrangement for determining the initial value and the instantaneous value of the radius of the roll.

FIG. 4 shows, schematically, the instrumentation for determining the radius of a new roll 1 and the radius of an unwinding roll 2. The position of roll carrier 3 corresponds to that of FIG. 3. Only those elements are shown which are required for determining radius.

A mark 51 is arranged on a disc fastened to the core of the roll or to the shaft of roll 2; passage of the mark is detected by a probe 52. Probe 52 generates a pulse for each revolution of roll 2 as mark 51 passes by.

A friction wheel 53, turned by web B, drives the pulse disc of a digital pulse generator 54; the pulse disc carries a large number of marks which are scanned by a second probe 55. Probe 55 therefore generates a predetermined number of pulses for a given length of web. The pulses from probe 55 are transmitted to, and counted by, a counter 60. Counter 60 is initiated by a first pulse from probe 52 and counts the pulses from probe 55 until a second pulse arrives from probe 52. The number of pulses received from probe 55 between two successive pulses of probe 52 is a measure of the length of web pulled off for one revolution of roll 2 and is therefore also a measure of the radius $R_W$ of roll 2.

A disc fastened to the core of the roll or to the shaft of new roll 1 carries a further mark 56 which actuates another pickup 57. Assuming that the velocity of web B as it slows down agrees with the circumferential velocity of new roll 1, the radius $R_{Wo}$ of new roll 1 can be determined in another counting device 61 by counting the number of pulses from probe 55 between two pulses of probe 57. The radius $R_{Wo}$ is determined by closing switch 58 by an appropriate command when synchronous operation is reached at the end of acceleration of new roll 1. The counting device then counts the number of pulses of probe 55 during one revolution of new roll 1, providing, in the number of pulses received by probe 55, a direct measure of the radius RWo of new roll 1.

Eq. (6.2) also requires the radius r of the drive rollers of the belt drive. This radius is known and can be entered as a fixed number.

In addition, the synchronous speed $n_s$ at which the velocity of the unwinding web B agrees with the circumferential velocity of new roll 1 is required. The synchronous speed $n_s$ can be determined from the speed measured by tachometer generator 7, taking into consideration the transmission ratio $r/R_{Wo}$, or directly from the tachometer voltage of tachometer generator 20.

In addition, the time $t_s$ which the drive requires for accelerating the new roll with a fixed amount of torque from standstill to the synchronous speed $n_s$ is measured.

For fixing the predetermined driving torque, drive motor 5 can be regulated, in principle, to constant torque. In the present case, however, it is sufficient if the torque of motor 5 is considered to be directly proportional to the armature current. Then, regulation to constant armature current is possible without problem by designing starting-up transmitter 37 accordingly.

The moment of inertia $J_M$ of the drive is known and can be assumed as constant. It can be determined upon starting up.

The determination of the initial value $J_{Wo}$ of the moment of inertia of the winding is carried out as follows:

Belt drive 4 is lowered onto new roll 1. Motor 5 is switched on and is accelerated with constant current, preferably the rated current, until the synchronous speed $n_s$ is reached. As soon as it is determined that the synchronous speed $n_s$ is reached, the required time $t_s$ is measured. Then, the radius $R_{Wo}$ of new roll 1 is also determined. The pre-set value of the armature current $I_a$, the moment of inertia $J_M$ of the machine, and the radius r of the driving rollers of the belt drive are all known. From this, the initial value $J_{Wo}$ of the moment of inertia of the winding under a belt drive can be calculated directly according to Eq. (6.2g).

Figure 5:
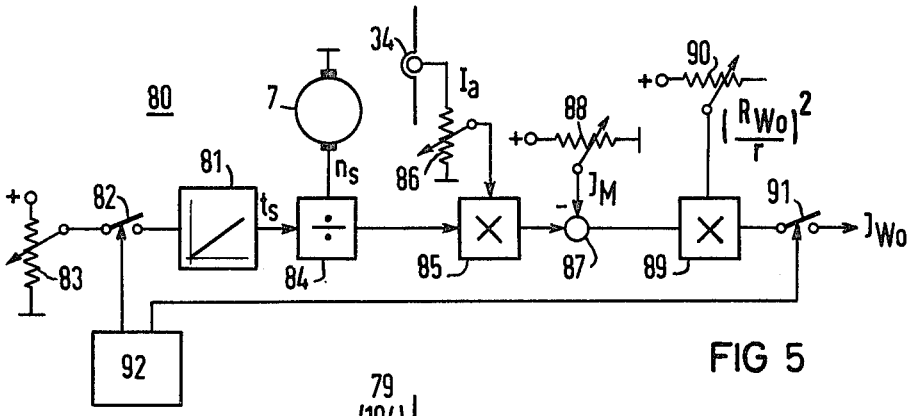
FIG. 5 is a schematic diagram of a circuit arrangement for determining the initial value of the moment of inertia of a roll in a system driven by a belt.

FIG. 5 shows an illustrative embodiment of circuit arrangement 80 useful in the apparatus of FIGS. 1–3 for determining the initial value $J_{Wo}$ of the roll when a belt drive is used. Circuit 80 contains an integrator 81, one input of which is connected to a potentiometer 83 through a switch 82 at the beginning of start-up of a new roll. Switch 82, which is operated by a command stage 92, is opened again when the roll has reached synchronous speed. This is determined by monitoring the control difference signal fed to speed control 30. Integrator 81 therefore integrates a constant input voltage until the synchronous speed is reached and the output voltage of integrator 81 is a measure of the starting-up time $t_s$.

Integrator 81 is followed by a divider stage 84, the dividend input of which is connected to the output of integrator 81 and the divisor input of which is connected to tachometer generator 7. The output of divider stage 84 is connected to one input of a multiplier 85, the second input of which is connected to a voltage proportional to the armature current $I_a$ of motor 5. The armature current is a measure of the driving torque of the machine. To take the proportionality factors into consideration, the voltage imaging the armature current is fed in via a potentiometer 86. The output voltage of multiplier 85 is compared in a comparator 87 with a voltage which is set at a value corresponding to the moment of inertia $J_M$ of the drive, for instance, by means of another potentiometer 88. The output voltage of comparator 87 is fed to one input of multiplier 89; the other input of multiplier 89 is addressed by a voltage which corresponds to the value $(R_{Wo}/r)^2$. This voltage can be supplied, for instance, by a potentiometer 90 which is connected to a voltage determined by counting device 61, or the position of the tap can be varied by counting device 61. The output voltage of multiplier 89 is a measure of the desired initial value $J_{Wo}$ of the moment of inertia of a winding under belt drive. It is fed, via a switch 91, to the computer 50 of FIGS. 1 to 3. Switch 91 is closed by the command stage 92 as soon as the synchronous speed is reached, and opened again immediately after the initial value $J_{Wo}$ of the moment of inertia of the winding is transferred.

First, the initial value $T_{So}$ of the time constant of the system is needed. Under the assumption made regarding linear acceleration, $T_{So}$ is obtained according to Eq. (7):

$$T_{So}=(n_n/n_s)\cdot t_s \tag{7}$$

From this follows the initial value $V_{Ro}$ of the optimized control gain according to Eq. (2.3) from relation Eq. (2.2) as:

$$V_{Ro}=k_a\cdot T_{So} \tag{2.3}$$

The time constant $T_S$ of the system, which changes continuously with decreasing winding radius $R_W$ can be determined via the relation (8):

$$T_S/T_{So}=J/J_o \tag{8}$$

For the instantaneous moment of inertia J we have as Eq. (6.3g) the equation shown in general form:

$$J=J_M+(r/R_w)^2\cdot J_W \tag{6.3g}$$

Solving relation (8) for $T_S$ and substituting Eq. (6.3g) yields Eq. (8.1g) for a winding with belt drive:

$$T_{Sg}=T_{So}/J_o\cdot J=T_{So}\cdot J_M/J_o+T_{So}\cdot(r/R_w)^2\cdot J_W/J_o \tag{8.1g}$$

Since for the instantaneous moment of inertia $J_W$ of the winding, we have the relation (9):

$$J_W/J_{Wo}=(R_W/R_{Wo})^4, \tag{9}$$

Eq. (8.1g) assumes the form:

$$T_{Sg}=T_{So}\cdot J_M/J_o+T_{So}\cdot J_{Wo}\cdot r^2\cdot R_W^2/J_o\cdot R_{Wo}^2 \tag{8.2g}$$

Eq. (8.2g) is the desired function (4) for a winding with belt drive.

If a term specific for an angle $$A=T_{So}\cdot(J_M/J_o) \tag{10}$$

and a factor $k_g$ specific for a belt drive $$k_g=T_{So}\cdot J_{Wo}/J_o\cdot r^2\cdot R_{Wo}^2$$

is introduced, then Eq. (8.2g) assumes the form:

$$T_S=A+k_g\cdot R_W^2 \tag{8.3g}$$

For optimized control gain $V_{Rg}$ of a speed controller for a winding with belt drive, Eq. (2.4g) applies:

$$V_{Rg}=k_a(A+k_g\cdot R_W^2) \tag{2.4g}$$

Eq. (2.4g) is continuously calculated by computing device 50 and the optimized control gain is set into speed controller 13.

With respect to the integral-action time TI of a PI-controller, the optimizing condition (12) applies for satisfactory compensation of disturbances with 20% overshoot:

$$T_I=2.3\cdot T_u \tag{12}$$

Since the delay time $T_u$ of the system can be considered as constant, as already mentioned, the integral-action time $T_I$ of the speed control can be set in as fixed for such a control behavior.

If, however, good control behavior is required of a PI-controller, the optimizing condition (13) applies for 20% permissible overshoot and minimum duration of oscillations:

$$T_I=T_S \tag{13}$$

To obtain such control behavior, the optimized integral-action time TI of the speed controller 13 can be determined continuously from Eq. (12).

Figure 6:
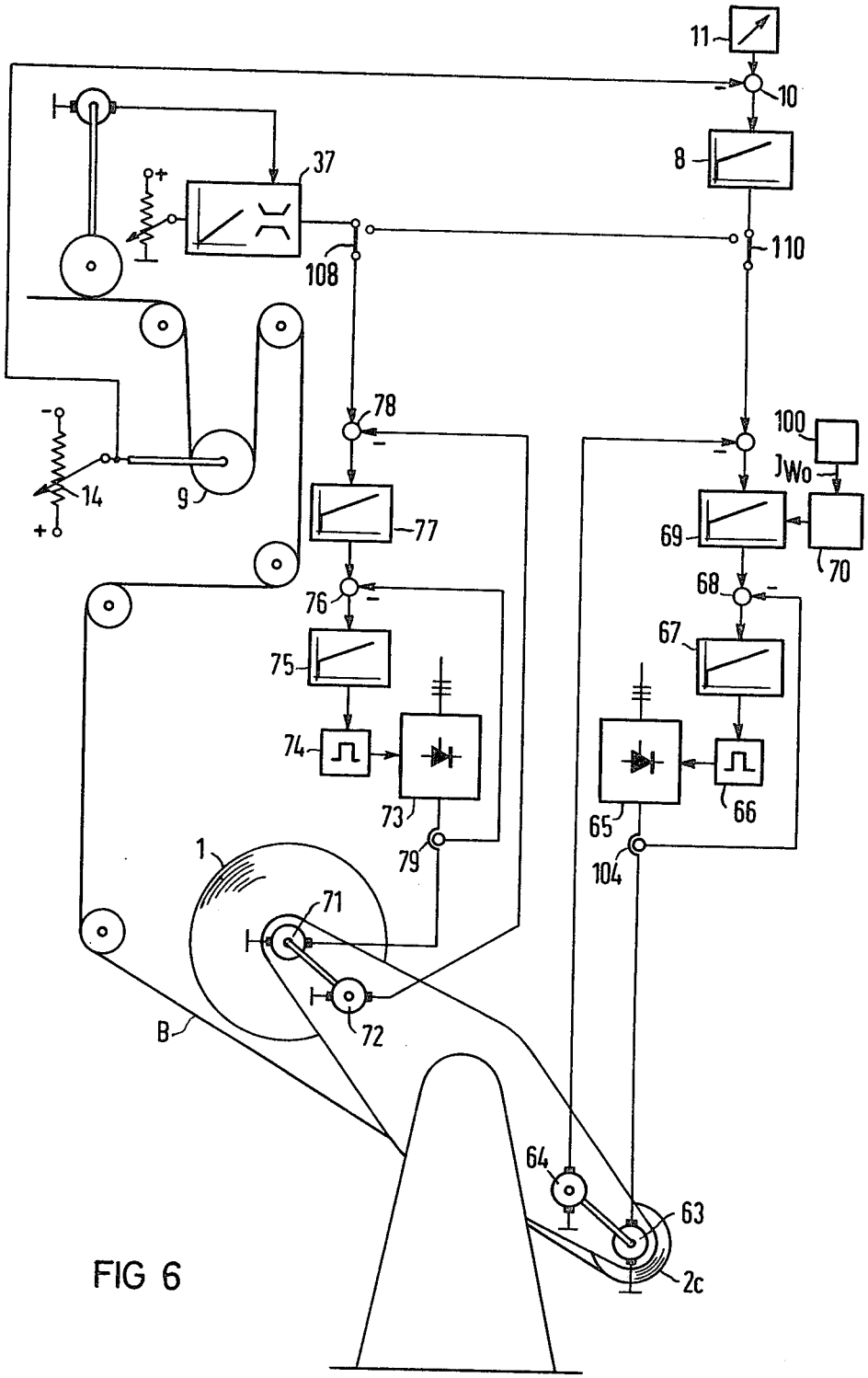
FIG. 6 is a schematic diagram of a roll carrier having a direct drive, shown in the gluing position.

FIG. 6 shows a two-arm roll carrier 3, which has direct drive, in the gluing position in a presentation comparable to that of FIG. 3. In it, unwinding roll 2c is driven or braked directly by a motor (electric machine) 63. The speed of motor 63, and, therefore, the speed of unwinding roll 2c, is measured by a tachometer generator 64. Motor 63 is powered by a converter 65 which is designed as a four-quadrant control element. The speed of motor 63 is controlled by a speed controller 69, to which a current regulator 67 is subordinated. To obtain constant web tension, a position control having compensating roller 9 for obtaining an actual position value, a setting device 11 for setting a position reference value, a comparator 10 for forming a position difference signal from the position reference value and the actual position value, and a position controller 8 are provided. The output voltage of position controller 8 constitutes the reference voltage for speed controller 69, the actual value for the speed controller being formed by tachometer generator 64. The control gain and the variable (integral-action) time of speed controller 69 are set by a computing device 70 which will be explained later on. The output signal of speed controller 69 is the reference value for subordinated current regulator 67 and is compared with the actual current value in a comparator 68. The output voltage of the subordinated current controller controls the firing angle of the firing pulses of a control unit 66.

An identically designed direct drive is associated with new roll 1. Its design will be described, together with its operation in accelerating the new roll to the synchronous speed ns. The motor (electric machine) 71 for driving new roll 1 is fed from a converter 73, which is designed as a four-quadrant control element. A speed controller 77 having a subordinated current regulator 75 is associated with the converter 73. During the acceleration of new roll 1, starting-up transmitter 37, which is again operative, brings up the reference value for the speed controller according to a predetermined ramp function until synchronous speed is reached. The output signal of start-up transmitter 37 is compared in a comparator 78 with the actual speed value taken from a tachometer generator 72 connected to motor 71. The speed difference address speed controller 77. The output voltage of speed controller 77 forms the reference value for the subordinated current regulator 75 which is compared with the actual current value in comparator 76. The control difference signal output of comparator 76 addresses current regulator 75. The output voltage of current regulator 75 is the control voltage for control unit 74 for generating the firing pulses for the converter 73.

In the case of a roll carrier having direct drive, a change of roll takes place in a manner similar to that for a roll carrier having belt drive. However, since both rolls are equipped with direct drive, the separate induction brakes of FIGS. 1–3 are not needed and the roll change cycle is somewhat simpler. At first the web unwinds from the old roll in the normal unwinding position in a manner analogous to FIG. 1. Web tension is controlled by direct drive 63 in response to position control 8, speed controller 69, and subordinated current regulator 67. The control parameters of speed controller 69 are continuously determined by the computing device 70. Immediately prior to the gluing operation, the roll carrier is swung into the gluing position shown in FIG. 6. Unwinding roll 2c continues to be regulated by the engagement of direct drive 63. Simultaneously, the new roll 1 is accelerated to synchronous speed in the manner described. In the process, those data, which are required for calculating the initial value of the moment of inertia of the new roll and the initial value of its radius, are determined. Immediately prior to the gluing command, the setting of optimized control parameters by computing device 70 into speed controller 69 ceases. Computing device 70 receives the data obtained during acceleration of the new roll and calculates, from the initial value of the moment of inertia of the new roll and the initial value of its radius, the optimized control parameters for speed control of the new roll following the gluing operation. At the gluing command, starting-up transmitting 37 is switched off and the output signal of position control 8 is switched instead, via switches 108 and 110, to comparator 78 of speed controller 77. At the same time, the initial values of the optimized control parameters are set into speed controller 77 by computing device 70. Subsequently, computing device 70 continuously determines the optimized control parameters from the decrease of the radius of the winding. Drive 63 is disconnected, the residual roll removed and a new roll inserted. Drive 63 is shut down until the next gluing operation.

For the necessary calculations, Eqs. (1) to (3) apply in the same manner as above, for the control optimization:

$$V_K = a \cdot T_S / T_u \quad (1)$$

$$V_K = V_R \cdot V_S \quad (2)$$

$$V_R = a / T_u \cdot V_S \cdot T_S \quad (2.1)$$

$$k_a = a / T_u \cdot V_S \quad (3)$$

$$V_R = k_a \cdot T_S \quad (2.2)$$

For the starting up time $t_s$, Eq. (5) likewise applies for substantially linear acceleration:

$$t_s = 2\pi \cdot n_s \cdot J_o / M_k \quad (5)$$

which can again be transformed into Eq. (5.1):

$$J_o = t_s \cdot M_k / 2\pi \cdot n_s \quad (5.1)$$

For a winding driven by a direct drive (subscript d), however, Eq. (14d) applies instead of Eq. (6g):

$$J_o = J_m + J_{Wo} \quad (14d)$$

For the initial value of the moment of inertia $J_{Wo}$ of the winding, Eq. (5.1) can be substituted in Eq. (14d):

$$J_{Wo} = t_s \cdot M_k / 2\pi \cdot n_s - J_M \quad (14.1d)$$

The initial value of the moment of inertia of the winding can therefore be calculated by Eq. (14.1d), if the synchronous speed $n_s$, the acceleration time $t_s$ until the synchronous speed is reached, the driving torque $M_k$ of the machine, or the armature current proportional thereto, as well as the moment of inertia $J_M$ of the drive are known. These quantities are determined in the same manner as already described. For the initial value $T_{So}$ of the time constant of the system, we have again:

$$T_{So} = (n_n / n_s)\ t_s \quad (7)$$

From this follows the initial value $V_{Ro}$ of the optimized control gain according to Eq. (2.3):

$$V_{Ro} = k_a \cdot T_{So} \quad (2.3)$$

For the instantaneous value of the time constant $T_S$ of the system we have again Eq. (8):

$$T_S / T_{So} = J / J_o \quad (8)$$

For the instantaneous value J of the entire moment of inertia referred to the drive, Eq. (14.d) applies in the general form (14.2d):

$$J = J_M + J_W \quad (14.2d)$$

If relation (8) is again solved for $T_S$ and if Eq. (14.2d) is substituted, Eq. (15d) is obtained:

$$T_S = T_{So} / J_o \cdot J = T_{So} \cdot J_M / J_o + T_{So} / J_o \cdot J_W \quad (15d)$$

With Eq. (9)

$$J_W / J_{Wo} = (R_W / R_{Wo})^4 \quad (9)$$

Eq. (15d) assumes the form:

$$T_{Sd} = T_{So} \cdot J_M / J_o + T_{So} \cdot J_{Wo} / J_o \cdot R_{Wo} \cdot R_W^2 \quad (15.1d)$$

If now the term A specific for the winding according to Eq. (10)

$$A = (T_{So} \cdot J_M) / J_o$$

and a factor $k_d$ specific for direct drive according to Eq. (16d) are introduced, $$k_d=(T_{So}\cdot J_{Wo})/(J_o\cdot R_{Wo}^4) \quad (16d)$$

are introduced, Eq. (15.1) assumes the form (15.2d):

$$T_{Sd}=A+k_d\cdot R_W^4 \quad (15.2d)$$

For optimum control gain $V_{Rd}$ of a speed control in the case of a roll having direct drive, Eq. (2.5d) then applies:

$$V_{Rd}=k_a(A+k_d\cdot R_W^4) \quad (2.5d)$$

Figure 7:
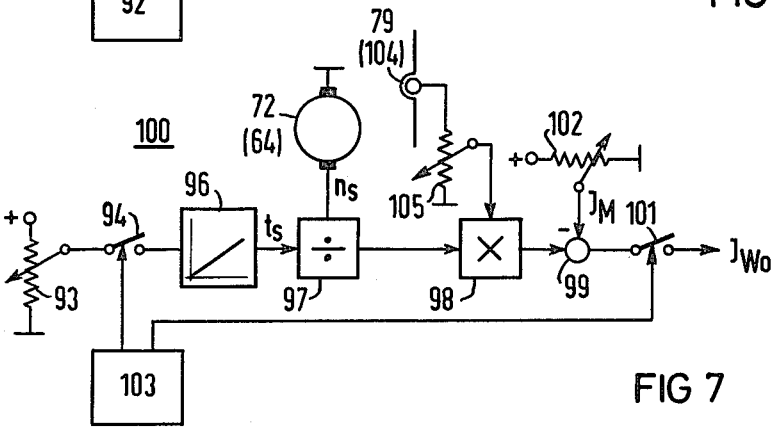
FIG. 7 is a schematic diagram of a circuit arrangement for determining the initial value of the moment of inertia of a roll in a system having direct drive.

FIG. 7 shows an illustrative embodiment of a circuit 100 for determining the initial value $J_{Wo}$ of the winding with direct drive. Circuit 100 contains an integrator 96 which, at the start of acceleration of a new roll is connected, via a switch 94, to a potentiometer 93. Switch 94, which is operated by a command stage 103, is opened again when the roll has reached the synchronous speed $n_s$. Integrator 96 thus integrates a constant upon voltage until synchronous speed is reached. The output voltage of integrator 96 is a measure of the starting-up time $t_s$.

Integrator 96 is followed by a divider 97, the dividend input of which is connected to the output of integrator 96 and the divisor input to a tachometer generator 72, which, as shown in FIG. 6, is coupled to direct drive 71 for new roll 1. At the next roll change, the divisor input of divider 97 is connected to the other tachometer generator 64. The output of divider 97 is connected to one input of a multiplier 98, the second input of which is connected to current measuring transformer 79 for measuring the armature current of direct drive 71 of new roll 1. At the next roll change, this input of multiplier 98 is connected to current measuring transformer 104 of the other direct drive. The armature current of the motor which is accelerating a new roll 1 is again a measure for the driving torque. To take the proportionality factors into consideration, the measure voltage for armature current is conducted, as before, via a potentiometer 105. The output voltage of multiplier 98 is compared in a comparator 99 with a voltage which is set, for instance, on another potentiometer 102 to a value corresponding to the moment of inertia $J_M$ of the drive. The output voltage of comparator 99 is a measure of the desired initial value $J_{Wo}$ of the moment of inertia of the winding under direct drive. It is fed, via a switch 101, to computer 70. Switch 101 is closed by the command stage 103 as soon as the synchronous speed is reached, and is opened again immediately after the initial value of the moment of inertia is taken into computing device 70.

Figure 8:
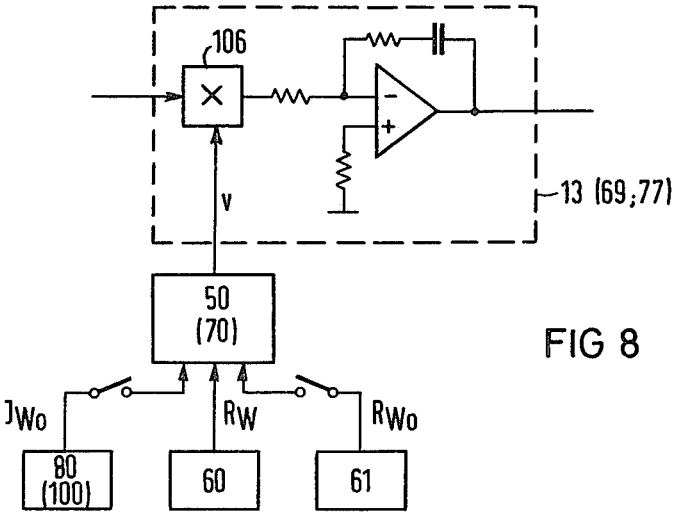
FIG. 8 is an illustrative embodiment of a control having optimizable control gain.

FIG. 8 shows the interconnection of a speed controller having adjustable control gain with a computing device, such as an analog-computer, and the circuits for determining the initial value of the moment of inertia of the winding, the initial value of the winding radius, and the actual winding radius. The reference symbols refer to the application to a roll carrier having belt drive as shown in FIGS. 1 to 5. The reference numbers for corresponding parts in the case of a roll carrier having direct drive as shown in FIGS. 6 and 7 are given in parentheses. Speed controller 13 contains an operational amplifier in which the feedback path comprises a capacitor and an ohmic resistor connected in series. The inverting input of the operational amplifier is supplied the control difference signal via an input resistor and a multiplier 106. The integral-action time of controller 13, which is defined as the product of the resistance of the input resistor in the inverting input and the capacity of the capacitor in the feed-back arm, remains constant since, according to assumption, the time constant of the system does not change. The control gain is the quotient of the resistance of the resistor in the feedback arm and the input resistor. This gain, given by the circuit connection of the control, is variable by a factor V, which is fed to multiplier 106 at its second input.

The factor V is supplied as the corresponding voltage by the computer 50 which continuously calculates Eq. (2.4g) for determining the optimized control gain. For this purpose, computer 50 receives the initial value $J_{Wo}$ of the moment of inertia of the winding, which is fed to it from circuit 80 (FIG. 5) at the end of acceleration of the new roll. Computer 50 further receives the initial value $R_{Wo}$ and the instantaneous value $R_W$ of the winding radius which are fed to it from the circuits shown in FIG. 4.

In the case of a roll carrier having direct drive, the optimized control gain is continuously determined by a computer according to Eq. (2.5d). The initial value $J_{Wo}$ of the moment of inertia of the winding required for this purpose is fed in, by circuit arrangement 100 of FIG. 7, at the end of acceleration of the new roll. The instantaneous winding radius $R_W$ is determined in the manner shown, for instance, in FIG. 4. The initial value of the winding radius is not needed in that case.

Besides the possibility for changing the effective control gain shown in FIG. 8, also other approaches known in control engineering are possible. In case the integral-action time of the control is also to be optimized, a capacitor having variable capacity can be inserted into the feedback path of the speed control. It is possible, for instance, to use a motor-driven variable capacitor which is controlled by the computer. Also, it will be understood by those skilled in the art that that the calculations called for in generating solutions to the equations, as specified herein, may be performed by the use of well-known analog circuits for performing addition, subtraction, division and multiplication, as appropriate to the algebraic function called for in the equation. For example, a programmable microcomputer like INTEL 8085 can be used as computer 50 or computing device 70.

What is claimed is:

1. In a control arrangement for rotating a roll held in a carrier and supplying a web under predetermined web tension, the roll being coupled to an electric driving and braking machine and the machine being coupled to a speed controller responding to optimized control valves continuously determined from system parameters, the improvement comprising:

means for generating a signal representing an initial value of the moment of inertia of a new roll during start-up of the new roll;

means for generating a signal representing the instantaneous radius of the roll at the point of unwinding of the web; and means responsive to said signals for regulating at least one of the optimized control gain and the optimized integral-action time of the speed controller.

2. In a control arrangement in accordance with claim 1 for use with a belt-driven roll carrier, the further improvement comprising:

the means for generating a signal representing an initial value of the moment of inertia being coupled to:

means supplying a signal representing a measured value of the synchronous speed of the roll;

means supplying a signal representing a measured value of the drive until synchronous speed is reached;

means supplying a signal representing a measured value of driving torque;

means supplying a signal representing an initial value of the radius of the new roll;

means supplying a signal representing a predetermined value of the moment of inertia of the drive; and means supplying a signal representing a radius constant for the driving roller in the drive belt.

3. In a control arrangement in accordance with claim 2, the further improvement comprising the means for generating a signal representative of the initial moment of inertia of a new roll being a circuit comprising:

(a) an integrator providing an output voltage proportional to the starting-up time, the integrator being coupled to a predetermined input voltage during acceleration of the new roll until the roll reaches synchronous speed;

(b) a divider for determining the synchronous speed of the new roll having inputs addressed by the output voltage of the integrator and by a voltage from a tachometer generator and having an output voltage;

(c) a multiplier having inputs addressed by the output voltage of the divider and by a voltage proportional to the driving torque of the machine, the multiplier providing an output voltage;

(d) a comparator for forming the difference of the output voltage of the multiplier and a voltage proportional to the moment of inertia of the machine; and (e) a second multiplier for forming a voltage proportional to the initial value of the moment of inertia of the roll and having inputs which are comprising the output voltage of the comparator and a voltage corresponding to the squared value of the ratio of the radius constant of the drive rollers of the belt drive to the initial value of the winding radius.

4. A control arrangement for a roll carrier having a motor directly coupled to a roll for timing it synchronous speed, comprising a circuit for determining the initial value of the moment of inertia of a roll on the carrier, the circuit having as inputs measure values for the synchronous speed of the roll, the time required for the roll to each synchronous speed, the driving torque of the drive motor and predetermined value for the moment of inertia of the drive.

5. A control arrangement for a roll carrier in accordance with claim 4 in which the circuit comprises:

(a) an integrator for forming a voltage proportional to the starting-up time, the integrator being coupled to a constant input voltage during acceleration of a new roll until synchronous speed is reached;

(b) a divider for determining when a new roll attains synchronous speed and having inputs which are addressed by the output voltage of the integrator and by a voltage from a tachometer generator;

(c) a multiplier having inputs which are addressed by the output voltage of the divider and by a voltage proportional to the driving torque of the machine; and (d) a comparator for forming a voltage proportional to the initial value of the moment of inertia of the roll from the difference of the output voltage of the multiplier and a voltage proportional to the moment of inertia of the drive.

* * * * *